United States Patent [19]

Smith

[11] Patent Number: 4,901,192

[45] Date of Patent: Feb. 13, 1990

[54] ELECTRICAL CIRCUIT FOR DRIVING A LOAD WITH A LARGE FORCE APPLIED INTERMITTENTLY

[75] Inventor: Nelson S. Smith, Morgantown, W. Va.

[73] Assignee: Frank M. Ellison, Charleston, W. Va.

[21] Appl. No.: 122,352

[22] Filed: Nov. 18, 1987

Related U.S. Application Data

[62] Division of Ser. No. 710,440, Mar. 11, 1985, Pat. No. 4,717,008.

[51] Int. Cl.[4] ..... H01H 47/02

[52] U.S. Cl. ..... 361/156; 307/132 R; 361/189

[58] Field of Search ..... 361/152, 156, 194, 195, 361/155, 189, 190; 307/132 R, 132 E, 132 EA, 132 V; 242/107.4 R, 107.6; 235/133 A; 200/38 R

[56] References Cited

U.S. PATENT DOCUMENTS

| | | | |
|---|---|---|---|
| 3,046,420 | 7/1962 | Ritzenthaler | 307/132 V |
| 4,133,020 | 1/1979 | MacLean | 361/156 |
| 4,335,418 | 6/1982 | Clement | 361/152 |
| 4,536,627 | 8/1985 | Duve | 200/38 R |
| 4,620,259 | 10/1986 | Oshizawa | 361/152 |
| 4,717,008 | 1/1988 | Ellison et al. | 194/343 |

*Primary Examiner*—L. T. Hix
*Assistant Examiner*—David M. Gray
*Attorney, Agent, or Firm*—William D. Hall

[57] ABSTRACT

An electrical circuit is employed for receiving current from a small battery and converting it into a large intermittent force which will move a heavy load. In the example shown the load is a clock spring which is wound in small increments by the large intermittent force. A capacitor is charged by the battery. The battery and capacitor, therefore, temporarily have a higher output current than the battery alone. The output of the battery and capacitor is applied to a solenoid for attracting an armature and providing the large force. The resulting movement of the armature opens the circuit to the solenoid but the solenoid remains energized temporarily since a small capacitor is across it. When the armature returns to its normal off position it reenergizes the solenoid. The resulting on and off operation of the solenoid continues until the clock spring is fully wound. The combination of the battery and capacitor which is across the battery also operates a second load intermittently and the energization of this second load is controlled by a switch operated by the armature of the solenoid.

18 Claims, 8 Drawing Sheets

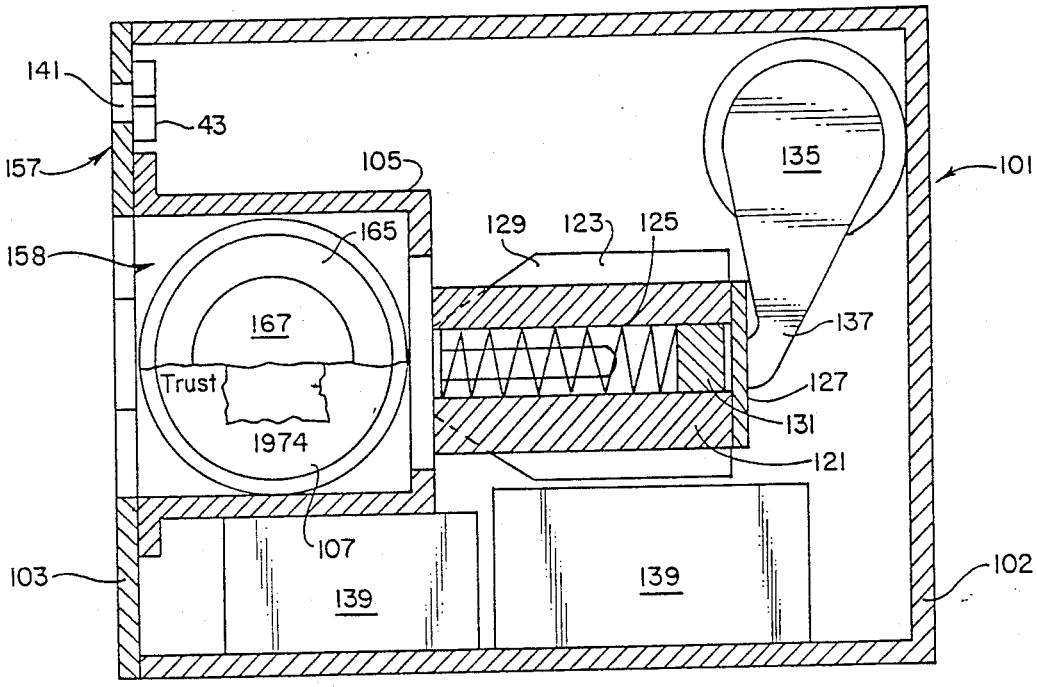
FIG. 11
FIG. 12
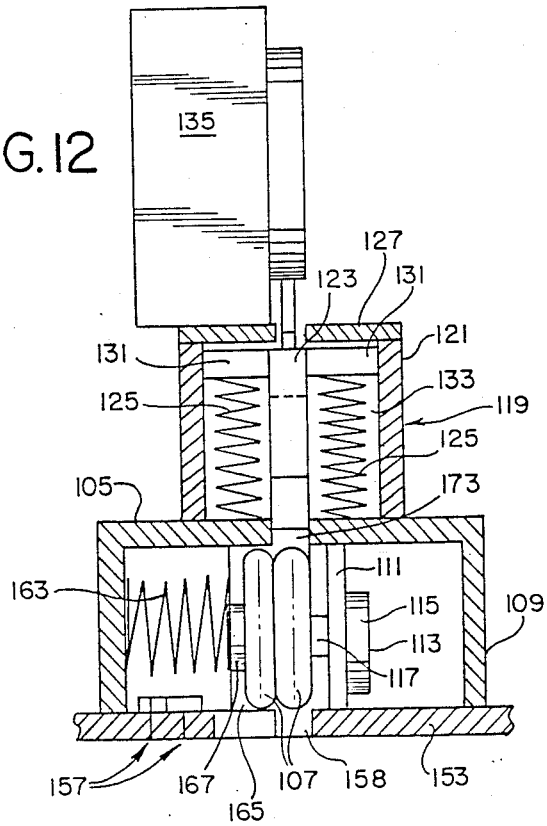
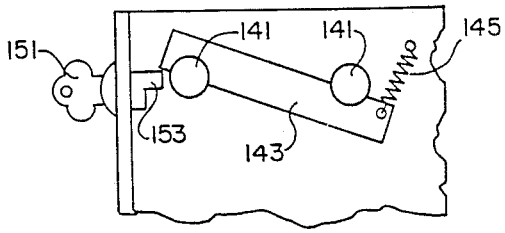
FIG. 13
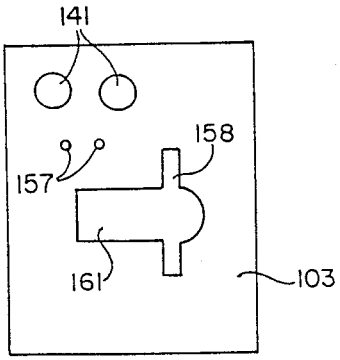
FIG. 14

FIG. 15
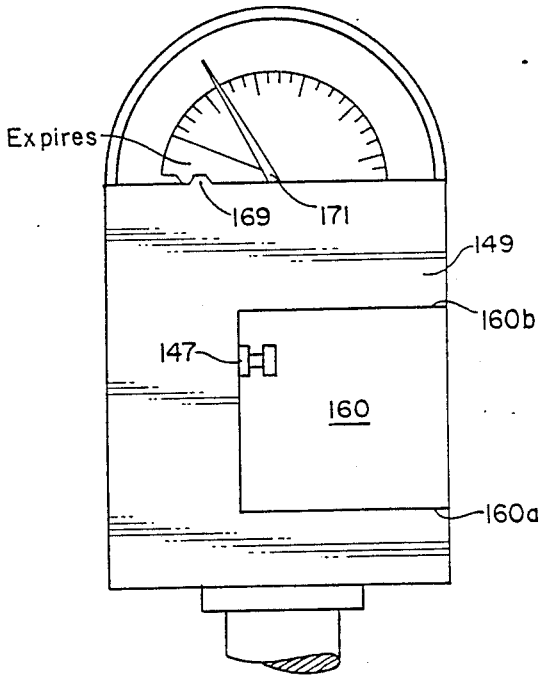
FIG. 16
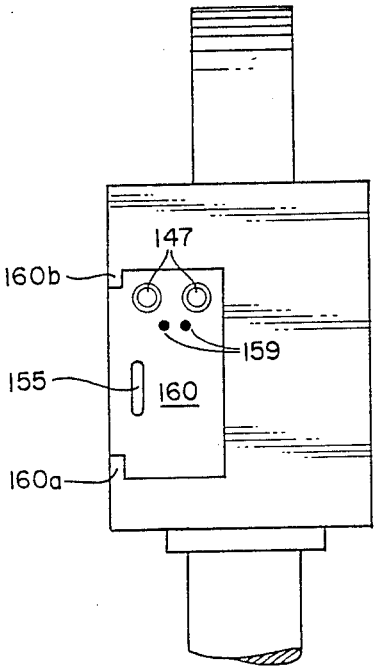
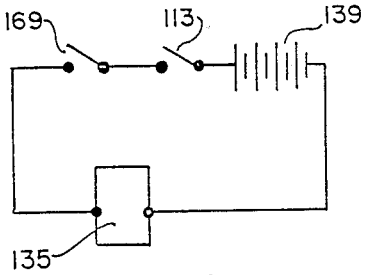
FIG. 17

ELECTRICAL CIRCUIT FOR DRIVING A LOAD WITH A LARGE FORCE APPLIED INTERMITTENTLY

RELATED APPLICATION

This application is a division of the prior copending application of Frank M. Ellison, Hasan T. Gencsoy and Nelson S. Smith, Jr., Ser. No. 710,440, filed March 11, 1985, entitled AUTOMATIC COIN FEEDER WITH WINDING MECHANISM, now U.S. Pat. No. 4,717,008.

BACKGROUND OF THE INVENTION

There are occasions where a large force is required to move a large load, yet only the power of a small battery is available. For example, it is desirable to wind the clockwork of a parking meter automatically after the automatic insertion of a coin. In such instance the only available power source may be a small battery.

SUMMARY OF THE INVENTION

The invention provides a circuit, operated by a small battery, for controlling two loads one of which produces a large intermittent force. The large intermittent force may be used, for example, to wind a clock spring in increments.

A first capacitor across the small battery is charged by the battery. The combination of the first capacitor and the battery energizes the two loads in a desired sequence. A first switch connects this combination to one of the loads and a second switch connects the combination to a solenoid which is part of the other load. The second switch is controlled by an armature which is operated by the solenoid to control the energization of one of the loads to cause it to intermittently deliver a large force. A small second capacitor is across the solenoid to cause it to remain energized for a short interval after the switch in series with it opens.

As a result, the combined battery and capacitor energizes the loads in a given sequence and one of the loads is energized intermittently so that it produces a large force intermittently.

The intermittent force may, for example, be employed to wind a clock spring in increments.

BRIEF DESCRIPTION OF THE DRAWINGS:

The accompanying drawings in conjunction with the description will make the invention more readily understood.

FIG. 11 is a side plan partially sectionalized view of an embodiment of this invention.

FIG. 12 is a top plan partially sectionalized view of the working mechanism of the embodiment of FIG. 11.

FIG. 13 is a partially fractured rear plan view of a locking mechanism as contemplated by this invention.

FIG. 14 is a front plan view of a front plate member of an embodiment of this invention.

FIG. 15 is a front plan view of a parking meter adapted to retain the embodiment of FIG. 11.

FIG. 16 is a side plan view of the parking meter of FIG. 15.

FIG. 17 illustrates one circuit that may be used for operating the coin dispenser 135.

DESCRIPTION OF THE PREFERRED EMBODIMENT

Figure 1:
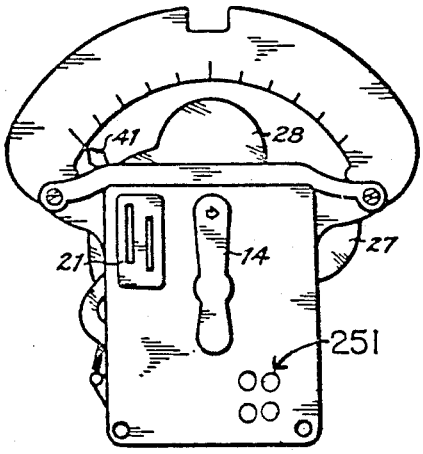
PRIOR ART FIG. 1
FIG. 1 is a front elevation view of a prior art Duncan parking meter as it appears when removed from its case.

Referring to FIG. 11, there is provided a container 101 for housing the operative mechanisms of the device. Container 101 includes sidewalls 102 and front plate member 103. Connected by its front surface to the inner surface of front plate member 103 is coin receptable means 105 which houses a plurality of coins 107 and which by a mechanism, hereinafter discussed, is capable of positioning a single coin in feeding position.

Adjacent receptacle 105 is a sensing means receptacle 109 (FIG. 12) which houses retaining plate 111 and switch sensing means 113. Switch sensing means 113 is comprised of a switch mechanism 115 retained on the back surface of plate 111 and sensor 117 which contacts the coin 107 being retained in dispensing position.

Retained behind receptacles 105 and 109, is a coin feeding mechanism 119 comprised of housing 121, coin pusher plate 123, a pair of compression coil springs 125, and a back retainer plate 127. Coin pusher plate 123 is comprised of a longitudinally extending relatively thin vertical plate 129 bifurcated at its forward end, and having provided on either side, at its rearward end, guide bars 131. Guide bars 131 are positioned in sliding relationship within longitudinally extending groove 133 of housing 121. Compression coil springs 125 are positioned between the back surface of walls 105 and the forward surface of guide bars 131 so as to normally bias coin pusher plate 123 out of contact with coin 107.

As can be seen from FIGS. 11–12, back retainer plates 127 have between them a space aligned with the rearward portion of coin pusher plate 123, such that a solenoid arm actuated mechanism 135, of any conventional design, may have its armature 137 positioned so as to push forward, into coin contacting and dispensing relationship, coin pusher plate 123.

In this respect, of course, it is understood that any type of rotary solenoid or the like may be employed. A typical example is one that is capable of rotating about 45° to exert the necessary force and distance in order to push coin 107 into the parking meter as shown in FIGS. 15–16.

Also located within container 101 are batteries 139 for operating the electronic circuitry and solenoid 135 (FIG. 17). Generally speaking, these batteries may be of any conventional type, usually combined, amounting to 6 or 12 volts DC.

In order to position the device into coin dispensing relationship with, for example, the parking meter shown in FIG. 15, there are provided two mechanisms in front plate members 103. The first is a locking mechanism generally best illustrated in FIG. 13 wherein there are provided two holes 141 and a swing bar 143 which is biased at one end by coil spring 145. By providing male locking members 147 within the internal wall of parking meter to prevent dislodgement thereof by way of vandalism or the like is obtained. This is accomplished by male locking members 147 extending through holes 141 and turning key 151 so as to rotate cam member 153 out of engagement with the end of swing bar 143. In such an instance, coil spring 145 biases swing bar 143 into locking engagement with male locking members 147. By retotating key 151 thereby bringing cam member 153 into engagement with 143 and in turn, cam member 153 into engagement with the end of swing bar 143 thereby raising it out of locking engagement with male members locking members 147, a convenient removal and locking mechanism is provided.

The second mechanism is provided to insure appropriate accurate alignment of the feeding mechanism with coin insertion orifice 155 of parking meter 149. In this respect, there is provided in the front surface of front plate member 103, a pair of male member pins 157 which are caused to align with female receptacle pin retaining means 159 in the internal surface of the housing of parking meter 149 as illustrated in FIG. 16. These pins can also serve as the electronic circuitry contact for a switch located in the meter, as hereinafter more fully explained.

One important feature of the preferred embodiments of this invention is that the dispensing mechanism and its housing may in its substantial entirety be retained within the housing of the parking meter. This is accomplished in FIGS. 15 and 16 by making receptacle 160 of slightly greater size than housing 101. This, coupled with receptable flanges 160A and 160B provide a strong environment for housing 101, which limits access to pins 147 and thus inhibits theft. In addition, retaining housing 101 within receptacle 160 prevents accidental or intentional striking of the feeding device that houses the coins to be dispensed.

As best illustrated in FIG. 14, front plate member 103 is provided with a coin dispensing slot 158 and a horizontal, substantially larger slot 161 sufficiently large to enable coins to be reinserted in the device, when the device is partially or fully emptied. The coin dispensing and retaining mechanism found in receptable 105 generally comprises a compression coil spring 163 and a coin retaining plate 165. Coin retaining plate 165, in turn, is provided with a concentrically oriented orifice 167 sufficiently large so as to allow sensor 117 to extend therewithin without contact when no coins are presented forward of coin retaining plate 165.

In order to actuate the coin dispensing mechanism, and with reference to FIG. 15, there is conventiently provided in parking meter 149 a switch mechanism 169 responsive to the operation of the meter. Switch 169 can be positioned in any convenient location either in the meter housing itself, or extending upwardly into the meter area (as illustrated) such that when need 171 of meter 149 indicates that time has expired, switch 169 is activated and send a signal via appropriate circuitry through male pin members 157 to solenoid 135, thus starting the coin dispensing operation.

Figure 3:
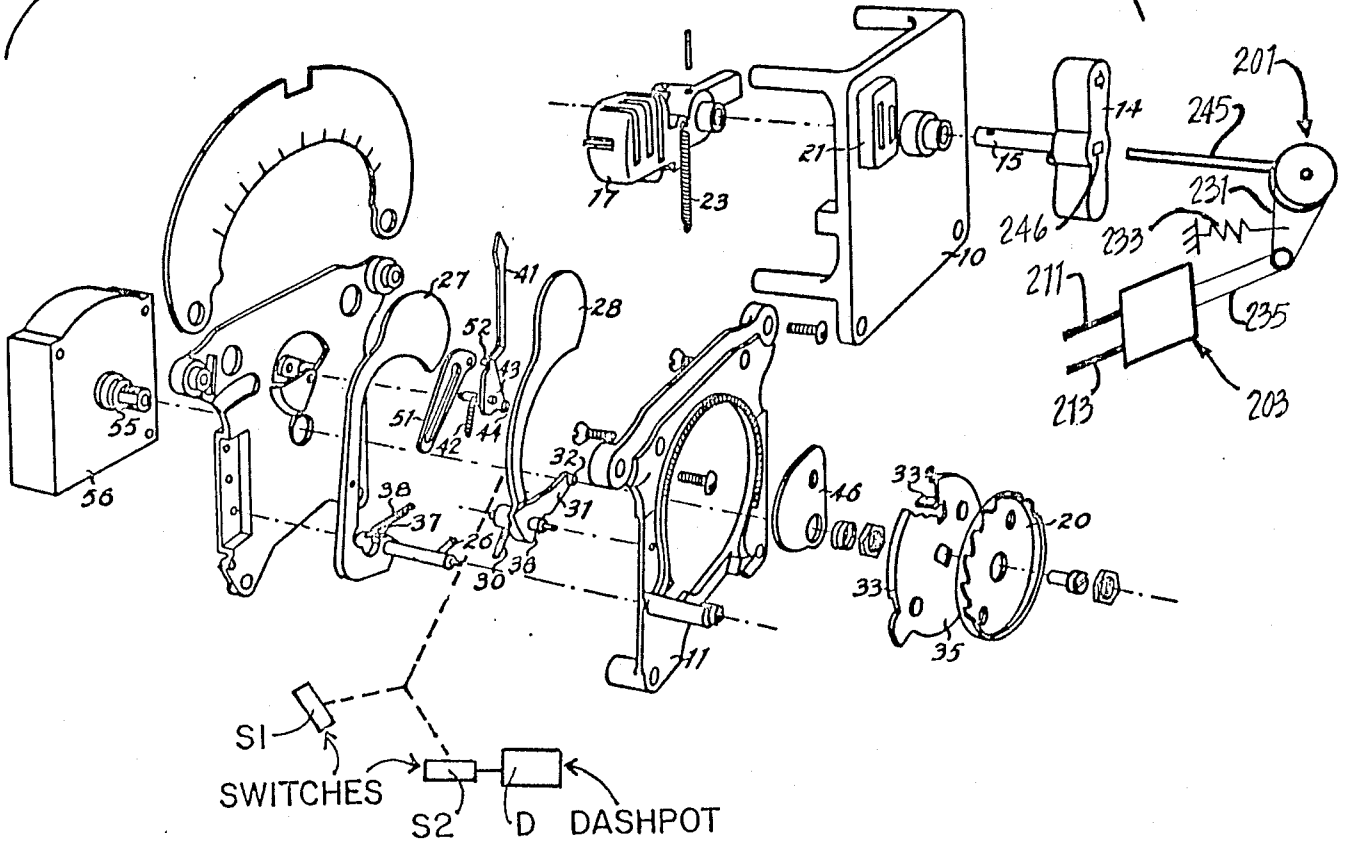
FIG. 3 is an exploded perspective view with one-directional clutch means for winding up the Duncan meter.

Switch 169, in a preferred embodiment, comprises switches S1 and S2 of FIG. 3.

This device is operated in the following manner: the appropriate number of coins is loaded into receptacle 105 via slot 161 and 159 by retracting plate 165 against compression spring 163. Upon release, spring 163 uncoils forcing the first coin into alignment with coin dispensing slot 158 and into alignment with vertical slot 173 housing coin pushing plate 123 extending through the rearward wall of receptacles 105 and 109. This also causes the first coin to contact sensor 117 and close switch 115.

Key 151 is then turned until cam member 153 contacts the lower surface of swing bar 143 opening holes 141. The device is then inserted into receptacle 160 in meter 149 using aligning male pins 157 inserted within female receiving orifices 159 and until male members 147 extend through receiving orifices 141. At this time, key 151 is rotated to eliminate contact between the lower surface of swing bar 143 and cam 153, thus causing coil spring 145 to bias swing bar 143 into locking engagement. Key 151 is removed, and the device is ready for dispensing a coin in response to signals from meter 149.

In the event that there is time still left on the meter, switch 169 is in open condition, and no activation, and therefore no feeding of a coin will take place.

Dispensing is accomplished by switch 169 activating solenoid 135, which causes armature 137 to rotate pushing forward coin pushing plate 123. In turn, the bifurcated end of coin pushing plate contacts coin 107, pushing it forward and into orifice 155, thereby feeding the coin to the meter 149. This causes the meter 149 to raise needle 171 to the indicated time paid for. Once needle 171 comes out of contact with switch 169, switch 169 is opened, thus deactivating solenoid 135 and allowing compressed coil spring 125 to return plate member 123 to its open or non-coin-engaging position. Rear plates 127 provide a stop mechanism for this return.

Upon return of plate 123, compressed coil spring 163 pushes forward the next coin 107 into coin dispensing alignment with coin dispensing slot 158. As needle 171 once again contacts switch 169, when time is expired, another coin will automatically be dispensed until no further coins remain in the device.

When the device is out of coins, sensor 117 will extend through, without contact, orifice 167 in plate 165, thus maintaining switch 115 in open condition. This prevents any further dispensing operation from taking place when the device is out of coins. An appropriate indicator light or other signaling mechanism can be provided in housing container 101 to indicate when switch 115 is open, thereby indicating that no coins remain in the device.

The device is easily removed for refill by rotating key 151 as explained hereinabove and removing the device from its contained receptacle in meter 149.

This invention is shown and described as a device attached to a particular Duncan parking meter. Hence the details of a typical Duncan parking meter are desirable for a full understanding of this particular embodiment of the invention. Therefore, I have incorporated herein sufficient drawings and written descriptions from U.S. Pat. No. 2,603,288 entitled Coin-Controlled Timing Apparatus, to Lester D. Sollenberger, dated July 15, 1982, to enable a specific parking meter, to which our invention may be added, to be understood.

Accordingly, FIGS. 1 to 10 of this application are taken directly from said Sollenberger U.S. Pat. No. 2,603,288, except that clutch 201, electromagnet 203, wires 211, 213, connecting rod 231, square shaft 245, switches S1 and S2, and sockets 251, have been added.

It should be understood that the coin feeding mechanism of FIGS. 11 to 14 is employed; that is the mechanism of FIGS. 11 and 12 is mounted directly on the parking meter of FIG. 1 so that the apparatus in casing 101 feeds coin 107 into slot 21 (FIG. 1) when switch S1 is closed, due to operation of time-expired flag 28 to its "violation" position.

Figure 19:
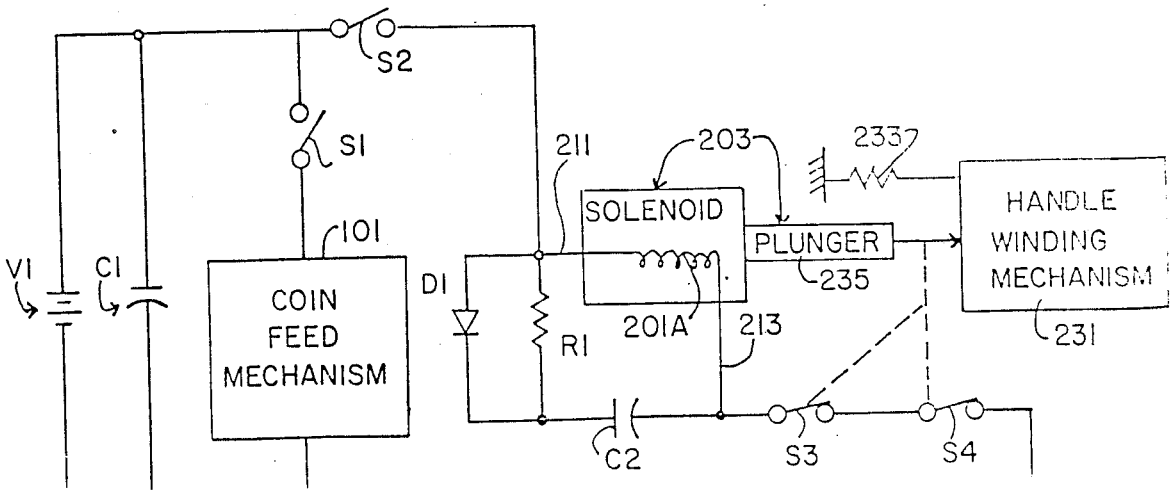
FIG. 19 is the circuit diagram for winding the time-spring shaft of the parking meter.

In this connection the casing 101 (FIG. 11), would, in this second embodiment of the invention, include in it the clutch 201, connecting rod 231, spring 233, electromagnet 203 (including plunger 235), wires 211 and 213, the circuit of FIG. 19 (except for switches S1 and S2), and a suitable square shaft 245 that fits in square hole 246 in the meter handle 14.

Figure 2:
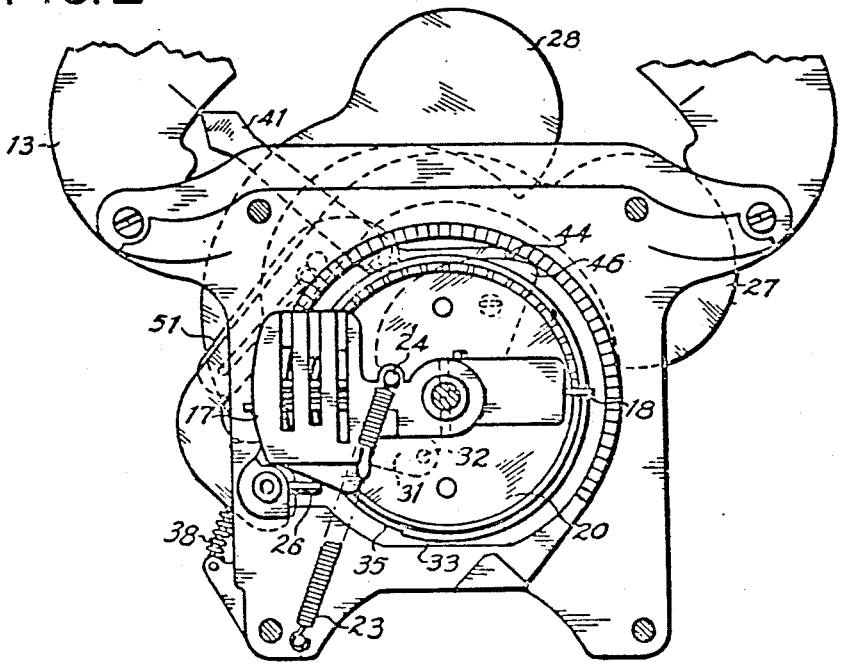
PRIOR ART FIG. 2
FIG. 2 is a front view, partly in section, of the Duncan meter.
Figure 5:
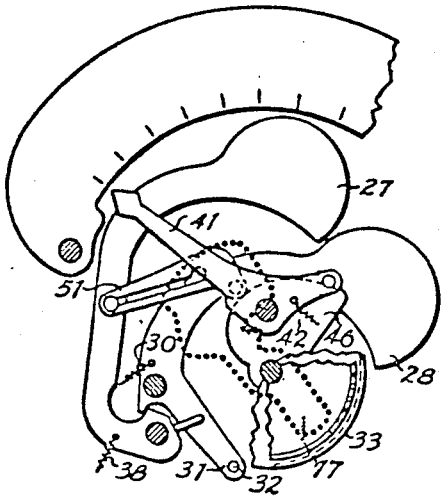
PRIOR ART FIG. 5
FIG. 5 through FIG. 10 are views similar to FIG. 4 of the Duncan meter exposing parts in their operative positions when the indicator is at different positions during the cycle of rotation.
Figure 6:
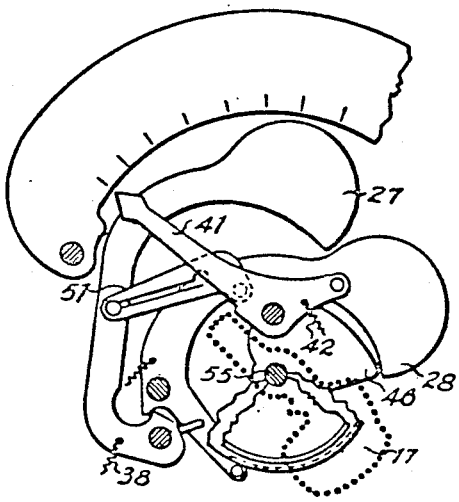
PRIOR ART FIG. 6
Figure 7:
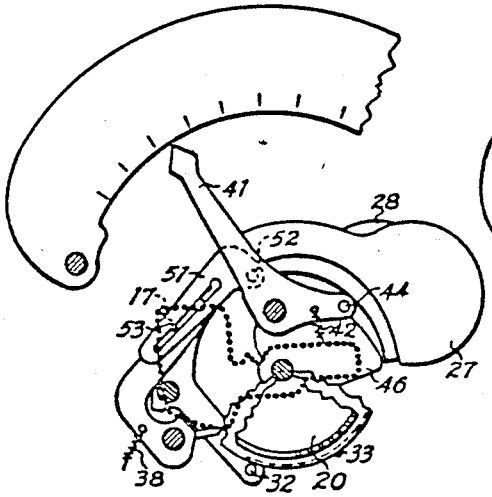
PRIOR ART FIG. 7
Figure 8:
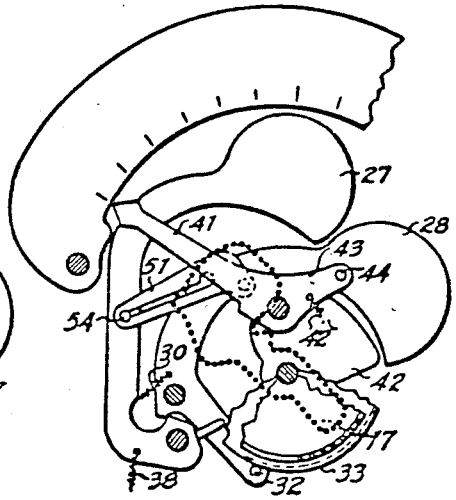
PRIOR ART FIG. 8
Figure 9:
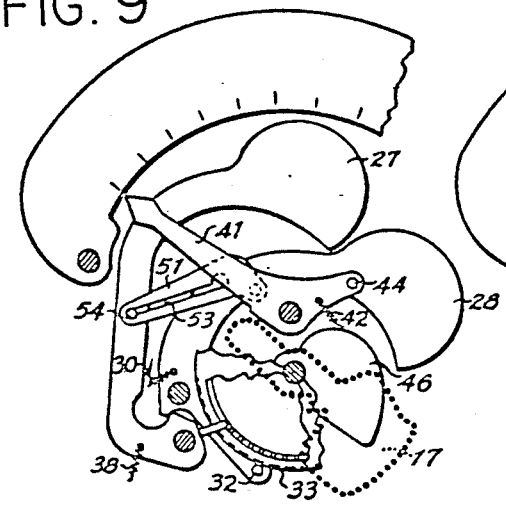
PRIOR ART FIG. 9
Figure 10:
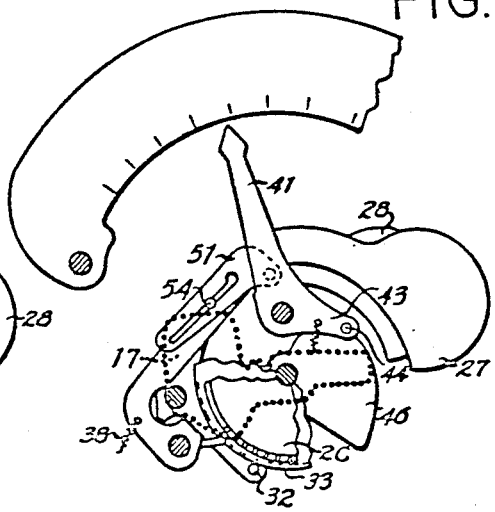
PRIOR ART FIG. 10
Figure 18:
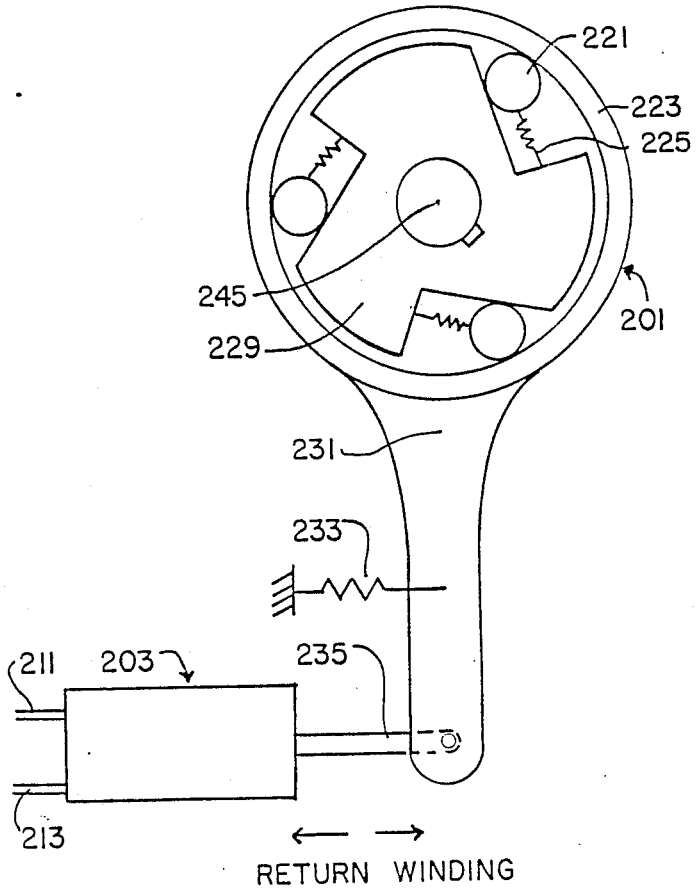
FIG. 18 is the exposed view of the one-directional clutch means for winding the meter shaft.

Before discussing the operation of the coin feeding mechanism for the Duncan parking meter, I will first explain how the Duncan meter operates without the invention. I do this by quoting from said Sollenberger U.S. Pat. No. 2,603,288 under the heading "Operation" as follows:

> In describing the operation of my invention, I shall first assume that it has been allowed to "run down"-that is that the previous user has exhausted the parking time for which he paid and that the newly arrived motorist finds the meter showing zero time.
>
> Under those conditions, the meter will have the external appearance indicated in FIG. 1, needle 41 indicating zero time and expired-time flag 28 being up.
>
> FIG. 2 shows in greater detail the position of the parts under those conditions. Control wheel 35 will be at its zero time position, whereat follower 32 will hve overrun the edge of cam surface 33. Under those conditions, spring 30 will have pulled flag 28 upward into view as shown in FIG. 1. Flag 27 will of course be down, since coin carrier 17 will be resting on lever 26, and powerful spring 23 will force flag 27 into retracted position despite the counter-force of spring 38. When the motorist deposits a coin into slot 21, it will drop into the appropriate slot in coin carrier 17. The motorist will then grasp handle 14 and rotate it in a clockwise direction. As soon as coin carrier 17 moves off of lever 25, spring 38 will cause flag 27 to rise, and simultancously therewith surface 37 will engage surface 36 and force flag 28 down. When that occurs, follower 32 is immediately moved outward to a point beyond the rim of control wheel 35, so that when flag 28 is released following clockwise rotation of wheel 35, follower 32 will press upon cam surface 33, which will then hold flag 28 down in retracted position so long as unexpired time remains on the meter.
>
> As clockwise movement of the handle continues, coin carrier 17 will "pick up" winding wheel 20 at a predetermined point, depending on the denomination of the coin inserted, and will thereupon carry with it winding wheel 20, control wheel 35, and cam 46 through the remainder of the cycle of clockwise rotation. (The details of the structure by which coin carrier 17 actuates winding wheel 20 are, as heretofore noted, fully disclosed in U.S. Pat. No. 1,799,056.)
>
> When the meter was in "time-expired" position, indicator 41 was, it will be understood, held in zero-time position by the pressure of cam 46 against the follower 44. (See FIG. 2.) As handle 14 is rotated by the motorist, cam 46 is moved in a clockwise direction through a predetermined arc, depending upon the denomination of the coin inserted, and as a result is moved out of engagement with follower 44. So long as handle 14 is away from its normal position of rest, however, indicator 41 will remain at zero-time position despite the movement of cam 46, however, because flag 27 will be up and link 51 will under those conditions hold indicator 41 against movement.
>
> Should the motorist fail to rotate handle 14 through its full cycle, the meter will show zero time and will also display red flag 27.
>
> When the handle 14 has been rotated to the limit of its clockwise movement, the coin will drop from the coin carrier into the coin receptacle (not shown) and handle 14 will thereupon be free to return to its rest position as soon as it is released by the motorist. When the handle has thus returned to its normal position, as shown in FIG. 1, coin carrier 17 will rest upon lever 26 and force flag 27 back to its retracted position. Lowering of flag 27 will release indicator 41, since pin 54 will ride up slot 53. Spring 42 will then cause indicator 41 to move clockwise until follower 44 comes into engagement with cam 46. The number of minutes indicated by needle 41 undere those conditions will depend, of course, on the magnitude of the arc through which cam 46 has moved, and that arc, in turn, will depend on the denomination of the coin inserted.
>
> Clockwork 56 will thereupon cause counterclockwise rotation of shaft 55 and control wheel 35. Wheel 35, by means of pin 33*a*, will carry cam 46 with it as it turns. As time passes cam 46 will force indicator 41 steadily to the left until, when the number of minutes purchased has elapsed, the needle will be forced back to zero. The relative positions on control wheel 35 and cam 46 are such that shortly after needle 41 has returned to zero cam surface 33 will move beyond follower 32, leaving spring 30 free to pull expired-time flag 28 upward into the position shown in FIGS. 1 and 2.
>
> The operation just described is shown in some detail in FIGS. 5–7 inclusive. FIG. 5 shows the parts in the position they occupy when coin carrier 17 has just started on its cycle of movement; FIG. 6 shows the position of the parts as coin carrier 17 has neared the extreme limit of its movement; and FIG. 7 shows the position of the parts after coin carrier 17 has completed its cycle and has been allowed to return to its rest position. It will be noted from FIG. 7 that indicator 41 has moved to the right from its zero position and indicates unexpired time.
>
> FIGS. 8–10 show the behavior of the apparatus when a coin is placed in the meter to purchase additional time when unexpired time still remains on the meter. FIG. 7 illustrates the starting condition--both flags down and unexpired time showing. When a coin is deposited and movement of handle 14 commenced, trouble flag 27 rises and indicator 41 immediately returns to zero. This condition is shown in FIG. 8. The zero indication by needle 41 continues until the full cycle of movement of the coin carrier 17 has been completed. FIG. 9 shows the position of the parts just before coin carrier 17 is allowed to return to its rest position. Rotation of coin carrier 17 through its entire cycle will, of course, have rotated winding wheel 20, control wheel 35, and cam 46 through a predetermined arc in the clockwise direction, the amount of arc depending on the denominallon of the coin used. When coin carrier 17 has returned to its rest position, as shown in FIG. 10, needle 41 will immediately move to the right under the impetus of spring 42 and will show the original time plus as many additional minutes as have been purchased by the newly inserted coin, since cam 46 will have been rotated clockwise from its former position by the number of additional degrees consistent with the denomination of the coin.

The significant point, from the standpoint of the present invention, is that throughout the adjustment process the indicator 41 showed zero time, notwithstanding the fact that the meter actually had unexpired time "stored" in the position of cam 46.

The clutch 201 may be of any suitable type that will, in response to clockwise movement of connecting rod 231, rotate handle 14 and thereby drive the conventional clockwork mechanism 56 to wind the same in response to energization of electromagnet 203. The connecting rod 231 of clutch 201, however, is disconnected from handle 14 and from clockwork mechanism 56 after the clockwork mechanism 56 is fully wound, and spring 233 returns the clutch 201 and electromagnet 203 to their normal off position.

Clutches, such as just described, that will drive a mechanism in one angular direction, yet disconnect the driving source from the load, in the opposite angular direction, are old and well known. Such a clutch is shown and described in U.S. Pat. No. 4,297,924. An adaptation of that clutch to the present invention is shown in FIG. 3.

The one-directional clutch 201 for winding the meter knob 14 which in turn winds clockwork 56, comprises a connecting rod 231 with its large end in the form of a circular rim 223 which is connected to the square shaft 245 through steel balls 221 supported by compressed springs 225 anchored to a fly wheel 229 mechanically connected to square shaft 245.

When the plunger 235 is activated by the counterclockwise turning of the rod 231 the friction between the circular rim 223 and the balls 221 causes the fly wheel 229 to be turned with the balls 221, thus winding the meter knob 14. The return stroke of the plunger 235 does not exert a torque on the square shaft 245 because the balls 221 compress the springs toward their anchorages on the flywheel 229 eliminating the friction between the balls 221 and the circular rim 223.

Prior to circuit activation by parking meter time expiration, switches S1 through S4 have their contacts in the states shown in FIG. 19 and the battery has charged capacitor C1 to 12 volts. The purpose of capacitor C1 is to provide a high current to the solenoid 203 for full activation overcoming the current limitation imposed by the internal resistance of the batteries V1.

Figure 3A:
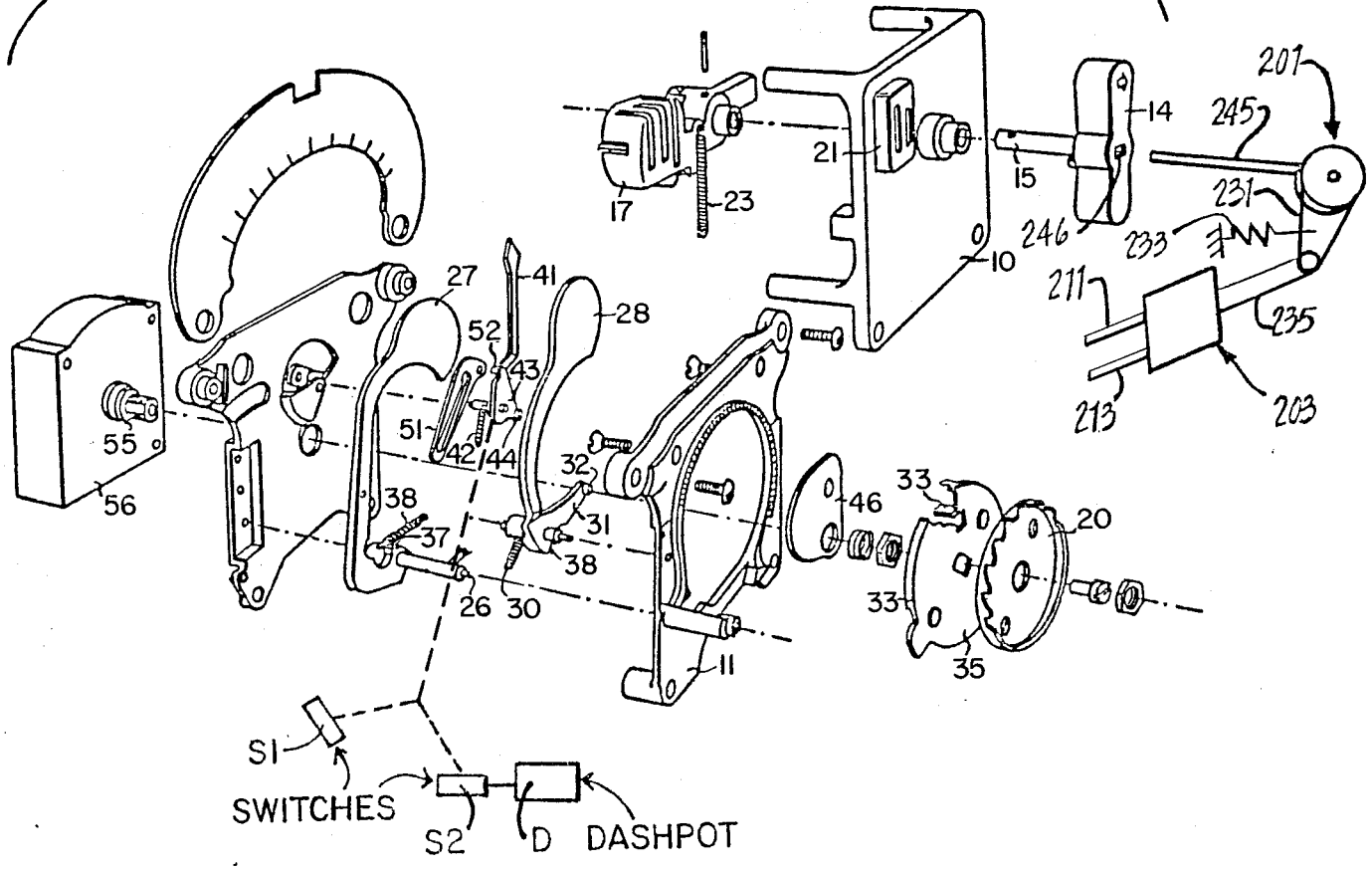
FIG. 3A is a modified form of the invention in which pointer 41 operates switches S1 and S2.
Figure 4:
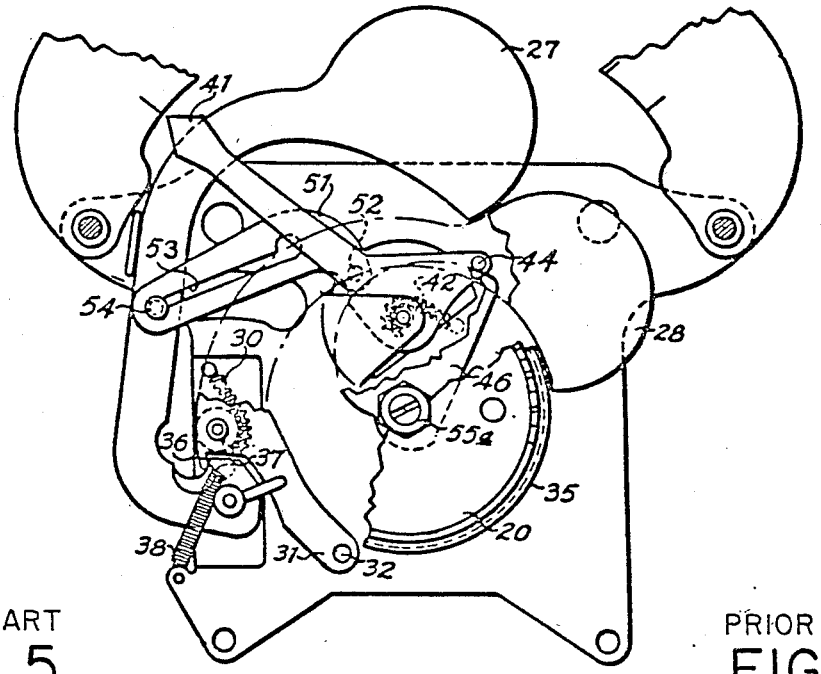
PRIOR ART FIG. 4
FIG. 4 is a fragmentary view of certain moving parts of the Duncan meter.

The circuit is activated by switches S1 and S2 being closed mechanically by the parking meter. The closure of switches S1 and S2 could be performed by any part of the parking meter which moves as the time is approaching expiration, for example, pointer 41 (FIG. 3A) or time-expired flag 28 (FIG. 3). In the example shown switches S1 and S2 are actuated when the time-expired flag 28 moves to its "violation" position. Closure of switch S1 activates the coin feed mechanism (FIGS. 11 and 12) which feeds a coin from the reservoir 105 into the parking meter. Switch S2 is a delay action switch which delays closing its circuit for one or two seconds after it is actuated by movement of flag 28 to its "violation" position. When switch S2 is closed, one or two seconds after switch S1 is closed, it applies 12 volts from the battery V1, and capacitor C2 is charged from capacitor C1, to 11 volts through the diode D1, and the solenoid 201A of electromagnet 203 is energized. Upon energization of solenoid 201A its plunger 235 activates the handle-winding rod 231 of the parking meter and advances it an increment where it is held mechanically. The motion of plunger 235 opens switch S3 as the plunger 235 first begins to move and then opens switch S4 at the end of its travel. With switch S3 open, the 12-volt battery circuit is removed from activation of the solenoid 203, but the charge stored on capacitor C2 keeps the solenoid 201A energized for 0.1 seconds (set by the choice of resistor R1 and capacitor C2). After capacitor C2 discharges, the solenoid plunger 235 returns to its de-energized position and, in so doing, first closes switch S4 then closes switch S3. Capacitor C2 is then again charged and solenoid 201A again energized to operate the plunger 235 and wind the parking meter handle 14 another increment. The battery V1 recharges capacitor C1 during the interval required for both of switches S3 and S4 to reclore. This process is repeated unitl, after several such increments, the meter is fully wound and the time-expired flag 28 moves away from the "violation" position and opens switches S1 and S2.

I will next discuss the "operation" of the second embodiment of the invention.

It will next discuss the "operation" of the second embodiment of the invention.

It is assumed that all of the parking meters in the parking lot have been modified as shown in FIG. 3. The driver of the car, parking next to the meter, then inserts a coin in the parking meter (FIG. 1), and then fills his coin dispensing apparatus (see FIGS. 11 and 12) with sufficient coins to cover the period for which he expects to park. He then locks casing 101 to the parking meter and removes the key 151.

When the time runs out, that was paid for with the manually inserted coin, the violation flag 28 will move to its "violation" position closing switch S1, and closing switch S2 a second or two later (FIG. 3). The delay of S2 is effectuated by the dashpot D. The battery V1 and capacitor C1 will now energize via switch S1 the rotary solenoid 135 and rotate arm 137 pressing coin 107 (FIG. 11) into slot 21 (FIG. 3). The meter will reset during the delay period of switch S2 which thereafter closes and thereby energizes electromagnet 203 which rotates connecting rod 231 and winds the handle 14, one increment, which in turn winds the clockwork mechanism 56, one increment, and thus resets the meter. The motion of plunger 235 opens switches S3 and S4 in sequence (FIG. 19), but the charge on capacitor C2 holds the solenoid 201A energized momentarily until the plunger 235 completes its power stroke. The electromagnet 203 is denergized a moment later when switch S3 opens, and spring 233 returns the system to its normal de-energized state. When condenser C2 is recharged the solenoid 201A will be re-energized giving plunger 235 another stroke. Thus, the plunger 235 will intermittently wind the parking meter clockwork 56 another increment until it is fully wound and flag 28 moved from its violation position.

When the time, paid for by the coin-automatically fed into the system expires, the "violation" flag 28 will again operate and the above recited process for automatically inserting a coin will be repeated. The coin emitting slot 158 (FIG. 11) and the square shaft 245 (FIG. 3) are so spaced that they perfectly mate with coin receiving slot 21 and square hole 246, respectively, when the casing 101 is clamped on the parking meter. Four pins may be provided on casing 101 (FIG. 11) to mate with the four sockets 251 (FIG. 1) to enable switches S1 and S2, which are in the parking meter itself to be connected to the electrical circuit (FIG. 19) all of which is in casing 101 except for the two switches S1 and S2.

If the device runs out of coins the meter will allow the time to expire, and the red "violation" flag 28 will appear. Since no coin will be inserted, the coin carrier 17 cannot rotate and it is not possible to rotate flag 28 from its violation position.

I claim to have invented:

1. In a device for moving a load over at least a given distance;

a plunger, means responsive to movement of said plunger in a first direction for moving said load an increment of said distance, a solenoid which when energized moves said plunger in said first direction to thereby move said load an increment of said distance, said plunger returning in a second direction which is opposite to said first direction after said plunger moves said load an increment, a capacitor, a direct current circuit for energizing said solenoid and said capacitor, switch means for opening said circuit after the plunger has started to move in said first direction and for reclosing said circuit after said plunger has moved a substantial distance in said second direction, means for interconnecting the solenoid and the capacitor so that the capacitor is charged when said circuit is closed and so that said capacitor energizes said solenoid for a limited time after said circuit is opened thereby causing said plunger to continue its travel in said first direction and move the load an incremental amount, said circuit, said solenoid, said capacitor, said first named means and said switch means comprising means for intermittently moving said plunger in said first direction to move the load in increments until the load has been moved at least said given distance, said direct current circuit including a battery whose internal resistance so limits its output current that such output current is inadequate to fully activate said solenoid, said direct current circuit also including a second capacitor which is charged by said battery and which will enhance said output current so that there is sufficient current for the actuation of said solenoid.

2. A device as defined in claim 1 in which said first-named means includes means for multiplying the force of said plunger and for applying the multiplied force to move said load.

3. A device as defined in claim 1 in which said direct current circuit comprises:

said solenoid having first and second sides and said switch means having first and second sides, a first conductor connecting one side of said battery to one side of said solenoid, a conductor connecting the other side of said solenoid to one side of said switch means, and a conductor connecting the other side of said switch means to the other side of said battery.

4. In a device for moving a load over at least a given distance;

a plunger, means responsive to movement of said plunger in a first direction for moving said load in an increment of said distance, a solenoid which when energized moves said plunger in said first direction to thereby move said load an increment of said distance, said plunger returning in a second direction which is opposite to said first direction after said plunger moves said load an increment, a capacitor, a direct current circuit for energizing said solenoid and said capacitor, switch means for opening said circuit after the plunger has started to move in said first direction and for reclosing said circuit after said plunger has moved a substantial distance in said second direction, means for interconnecting the solenoid and the capacitor so that the capacitor is charged when said circuit is closed and so that said capacitor energizes said solenoid for a limited time after said circuit is opened thereby causing said plunger to continue its travel in said first direction and move the load an incremental amount, said circuit, said solenoid, said capacitor, said first named means and said switch means comprising means for intermittently moving said plunger in said first direction to move the load in increments until the load has been moved at least said given distance, said direct current circuit comprising: a source of direct current, said source having first and second sides, a capacitor across said source, said solenoid having first and second sides and said switch means having first and second sides, a first conductor connecting one side of said source to one side of said solenoid, a conductor connecting the other side of said switch means to the other side of said source, a second load, said circuit including means comprising a first switch for energizing and deenergizing said second load, said first conductor having a second switch for opening and closing the circuit through said first conductor, and means for closing said first and second switches in a given sequence so that said first and second loads are controlled in a given sequence.

5. A device as defined in claim 4 in which the first switch is closed prior to the closing of the second switch.

6. A device as defined in claim 1 in which said load moves in said increments in an angular direction.

7. A device as defined in claim 6 in which said first-named means comprises a lever one end of which is pivoted and the other end of which is connected to said plunger, said one end of said lever being connected to said load to provide said load with movements in said increments in said angular direction.

8. In a device for moving a load in increments:

first means responsive to a direct current for moving said load an incremental amount, a battery and first capacitor means comprising second means for feeding a direct current to said first means to start an incremental movement of said load, third means responsive to movement of said first means for interrupting the flow of direct current to said first means, and second capacitor means which is charged by said second means for applying current to said first means to continue movement of said first means after said current is interrupted and for continuing said incremental movement after such movement was started by said second means, said first means, said second means, said third means and said second capacitor means comprising means for moving said first means in a plurality of increments and for moving said load at least two incremental amounts in the same direction, said battery having internal resistance which so limits its output current as to impair its ability to operate said first means to move said load an incremental amount, and said first capacitor means being charged by said battery and increasing the current delivered by second-named means so that said second-named means can provide current adequate to move said load an incremental amount.

9. A device as defined in claim 8 in which said third means interrupts the charging of said second capacitor means when it interrupts the flow of direct current to said first means.

10. A device as defined in claim 9 in which said third means comprises means for restoring a flow of direct current to said first means after an incremental movement of said load.

11. A device as defined in claim 10 in which said third means is responsive to a limited part of an incremental movement of said load for interrupting the flow of direct current to said first means.

12. A device for moving a load in increments as defined in claim 8 in which said first means moves the load in the same direction in response to each increment of movement.

13. A device for moving a load in increments comprising:

a source of electricity, means responsive to electricity from said source for moving said load an incremental amount in one direction, control means for pulsing the electricity from said source to said first-named means so that each pulse operates said first-named means to move said load at least part of an incremental amount, capacitor means charged by said source for applying electricity to said first-named means for completing each of the incremental movements of said load, said first-named means, said control means and said capacitor means comprising means for moving said load in one direction a plurality of increments without the load moving in a second direction, opposite to said first direction, between said increments, said source comprising a battery and an additional capacitor means charged by said battery, said additional capacitor means supplying current to said first-named means throughout the duration of each of said pulses.

14. A device as defined in claim 13 in which said first-named means includes lever means for multiplying the force applied to said load.

15. A device as defined in claim 13 in which said control means comprises a switch that disconnects said source from said first-named means when the first-named means moves part of an incremental amount in said one direction.

16. A device as defined in claim 13 in which said first-named means includes reciprocating means that moves in one direction in response to electricity from said source and from said capacitor means and then moves back in the opposite direction, said first-named means including means for moving said load said incremental amount when said reciprocating means moves in its said one direction but does not move the load while the reciprocating means is moving back.

17. A device for moving a load in increments, comprising:

a battery, a first capacitor charged by said battery, a solenoid, a second capacitor connected to deliver any charge stored therein to said solenoid to operate said solenoid, a circuit connecting said battery and said first capacitor to said second capacitor to deliver current from said battery to said second capacitor and to deliver at least part of the charge in said first capacitor to said second capacitor; to thereby sufficiently charge said second capacitor that it will in turn energize said solenoid, a plunger moved by said solenoid when said solenoid is energized, switch means in said circuit operated by said plunger and which opens said circuit to prevent further flow of current from said battery, and from said first capacitor, to said second capacitor after said plunger has been moved a limited distance in a first direction by said solenoid, said second capacitor continuing to energize said solenoid after said circuit has been opened so that said solenoid continues to move said plunger in said first direction, means for biasing said plunger for motion in a direction opposite to said first direction after the plunger has completed its move in said first direction and for operating said switch means to close said circuit and reconnect both said battery and said first capacitor to said second capacitor to thereby cause the plunger to again move in said first direction and when it has completed such second move in said first direction to move in said second direction, and a load moved an incremental amount in one direction each time said plunger is moved in said first direction so that the load moves a distance greater than said incremental amount in response to plural movements of said plunger in said first direction.

18. In a device for moving a load in increments:

a plunger movable in first and second opposite directions, a load which moves an incremental distance in one direction each time said plunger moves in said first direction so that after a plurality of movements of said plunger in said first direction said plunger will have moved a distance greater than said incremental distance, electromagnetic means for moving said plunger in said first direction thereby moving said load an incremental distance in said one direction, first capacitor means connected to said electromagnetic means for feeding a current to said electromagnetic means to operate the same to move said plunger in said first direction and to thereby move said load, a battery having sufficient internal resistance so that the current available from the battery is insufficient to energize said electromagnetic means to the extent necessary to actuate said solenoid to move said load by said incremental amount, a second capacitor connected to said battery for enhancing the output current therefrom, a circuit for feeding current from said battery and from said second capacitor, to charge said first capacitor, and switch means in said circuit for opening said circuit when said plunger moves in a first direction and closing said circuit when said plunger moves in a second direction, said first capacitor means comprising means for energizing said electromagnetic means after said switch means has opened said circuit so that said plunger continues its travel in said first direction by reason of the charge stored in said first capacitor.

* * * * *